US012807193B2

(12) United States Patent
Tancraitor et al.

(10) Patent No.: US 12,807,193 B2
(45) Date of Patent: Nov. 24, 2026

(54) SYSTEM FOR MOVING ALONG RAILS

(71) Applicant: Transportation IP Holdings, Norwalk, CT (US)

(72) Inventors: Troy Edward Tancraitor, Pittsburgh, PA (US); Andrew Jackson Guntrum, IV, Pittsburgh, PA (US); James David Lejeune, Pittsburgh, PA (US); Quentin Johann Torgerson, Pittsburgh, PA (US)

(73) Assignee: Transportation IP Holdings, LLC, Norwalk, CT (US)

( * ) Notice: Subject to any disclaimer, the term of this patent is extended or adjusted under 35 U.S.C. 154(b) by 556 days.

(21) Appl. No.: 18/456,220

(22) Filed: Aug. 25, 2023

(65) Prior Publication Data

US 2024/0425089 A1 Dec. 26, 2024

(30) Foreign Application Priority Data

Jun. 26, 2023 (EP) ..... 23181485

(51) Int. Cl.
*B61D 15/00* (2006.01)

(52) U.S. Cl.
CPC ..... *B61D 15/00* (2013.01)

(58) Field of Classification Search
CPC ..... B61D 15/00; B60L 2200/26
See application file for complete search history.

(56) References Cited

U.S. PATENT DOCUMENTS

2024/0425088 A1* 12/2024 Nye ..... B61B 13/12
2025/0100593 A1* 3/2025 Frisoli ..... B61D 15/12

FOREIGN PATENT DOCUMENTS

| | | | |
|---|---|---|---|
| CN | 204530352 | U | 8/2015 |
| CN | 208774769 | U | 4/2019 |
| CN | 208888146 | U | 5/2019 |
| ES | 2691145 | A1 | 11/2018 |

OTHER PUBLICATIONS

Extended European Search Report from corresponding EP Application No. 23181485.6, Nov. 27, 2023.

* cited by examiner

*Primary Examiner* — Scott A Browne
(74) *Attorney, Agent, or Firm* — K&L Gates LLP

(57) ABSTRACT

A system for moving below a train, wagon or car, the system having a plurality of support elements each resting on one or the two rails, the support elements being retractable when a train wheel passes, so that the support elements sequentially retract to allow the wheel to pass the system.

13 Claims, 4 Drawing Sheets

SYSTEM FOR MOVING ALONG RAILS

The present invention relates to a system for moving along rails and more particularly a system for inspecting portions of a train or a collection of train carriages or cars.

In a first aspect, the invention relates to a system comprising a frame having a longitudinal axis and, on each of two opposite sides of the longitudinal axis, a plurality of support structures each comprising:

- a support element configured to engage an upper surface of a railway rail,
- a connection element connecting the support element to the frame, the connection element allowing the support element to move, relative to the frame, from an operative position to an inoperative position, the connection element comprising a drive element for driving the support element from the operative position to the inoperative position and/or from the inoperative position to the operative position, where:

- at least part of each support element of each support structure on one of the sides of the longitudinal axis extending, when in the operative position and when the system is projected onto a horizontal plane, farther than a predetermined distance from the longitudinal axis,
- at least part of each support element of each support structure on the other of the sides of the longitudinal axis, the other side being opposite to the first side, extending, when in the operative position and when the system is projected onto the horizontal plane, farther than the predetermined distance from the longitudinal axis,
- no part of the support elements extends, when in the inoperative position and when the system is projected onto the horizontal plane, farther than the predetermined distance from the longitudinal axis.

In the present context, the system may be formed by a number of elements which are interconnected physically or wirelessly. The support elements may be the only elements supporting the frame so that the frame, supported by the support elements, may remain otherwise unsupported between the rails and not touching the ground or sleepers between the rails.

As will be described further below, the system may comprise a processor. This may be onboard or remote from the frame and connected by wire or wirelessly to the elements connected to the frame.

The frame has a longitudinal axis which normally would be a center axis of the frame. The longitudinal axis normally would be parallel to the rails or track and may be a center line between the rails.

The railway track usually has two rails which are at least substantially parallel and have the same distance between them, seen in a direction perpendicular to the direction of either rail.

A plurality of support structures are provided on either side of the longitudinal axis and thus engage each of the two rails along a plurality of positions thereof. This has the advantage that as a train wheel is passing, or as the system moves past a train wheel, it may require one or more of the support structures to not engage the rail, but others remain in engagement, so that the frame is supported by the rails even when train wheels pass.

Preferably, the support elements engaging one rail engage this rail at a plurality of known positions along the rail. These positions may be equidistant and determined based on the dimensions of train/wagon/car wheels and/or the distance between these on the train/car/wagon, such as on a bogie thereof.

Each support structure comprises a support element configured to engage an upper surface of a railway rail. This upper surface is the same surface by which the train wheels are supported when the train sits on or moves along the track.

In order for the frame to be supported by the support elements, a connection element is provided for each support structure for connecting the support element to the frame. Due to the fact that the train wheels are supported by the upper surface, the connection element allows the support element to move, relative to the frame, from an operative position to an inoperative position.

In the operative position, at least part of the support element extends, when projected onto a horizontal plane, farther than a predetermined distance from the longitudinal axis. The predetermined distance may be a distance from the longitudinal axis and to an inner edge of the upper surface of the rail, an inner surface of the head of the rail or an inner surface of the train/wagon/car wheel or the radially outermost portions thereof. When in the operative position, the support element extends to above the upper surface of the rail so that it may engage it such as being supported thereon.

In the inoperative position, no part of the support element extends, when projected onto the horizontal plane, farther than the predetermined distance from the longitudinal axis. Thus, the train/car/wagon wheel may pass this position of the system without engaging the support element. Or, if the system is in motion, this position of the system may pass the train/car/wagon wheel without the support element engaging the wheel. As described further below, the inoperative position may be a position where the support element is positioned so that it does not engage a train wheel when passing on the pertaining rail. The inoperative position may be positioned vertically as well as horizontally away from the operative position.

The connection element comprises a drive element for driving the support element from the operative position to the inoperative position and/or from the inoperative position to the operative position. The drive element may comprise any type of drive, such as a hydraulic drive, gas pressure drive, electrical or combustion motor/engine, or a passive drive, such as a spring or other resilient element biasing the support element toward one of the operative or inoperative position. A drive element may be configured to engage with the rail or a wheel of a train/wagon/car to derive force or torque therefrom for providing the driving operation.

At least part of each support element of each support structure on one of the sides of the longitudinal axis extend, when in the operative position and when the system is projected onto a horizontal plane, farther than a predetermined distance from the longitudinal axis. In this manner, all support elements, when in the operative position, may be supported on the pertaining rail. As long as one or more support elements are supported on the rail, others may be in the inoperative position.

The same is the situation for the support elements engaging the other rail of the track. At least part of each support element of each support structure on the other of the sides of the longitudinal axis, the other side being opposite to the first side, extending, when in the operative position and when the system is projected onto the horizontal plane, farther than the predetermined distance from the longitudinal axis.

No part of the support elements extends, when in the inoperative position and when the system is projected onto the horizontal plane, farther than the predetermined distance from the longitudinal axis.

It may be desired that the no part of the frame extends farther away from the axis than the predetermined distance. Thus, the frame, when projected onto the plane, is defined entirely between the rails. In this manner, no part of the frame will be engaged by any train/wagon/car wheels passing or passed by the frame on the rails.

Naturally, if the longitudinal axis is not defined at the centre between the rails, the above predetermined distance may not be the same on the two sides of the axis. Then, two predetermined distances would be used, but this does not alter the function of the support elements nor the operative and inoperative positions.

In one embodiment, the system further comprises a drive for moving the system along the rails. In this situation, the system may move along the rails and perform any desired function, such as moving goods or a payload below the train. This payload may comprise sensors or operating means for operating between the rails or below the train/wagon/car.

In a preferred embodiment, the support elements are support rollers or tracks, the system further comprising a drive connected to at least two of the support rollers/tracks so as to rotate these, Thus, the drive may be engaging the rails and move the system along the rails. Then, the system may comprise a power source, such as a combustion engine, a fuel cell, solar cells, or a battery, to power the drive. The drive may be autonomous, controlled by sensors of the system or remote controlled.

In one embodiment, at least one connection element comprises:

- a first portion fixed in relation to the frame,
- a second portion comprising the support element,
- the second portion being movable, by the pertaining drive element, in relation to the first portion to bring the support element from the operative position to the inoperative position.

Naturally, the first portion could form part of the frame. Preferably, this portion is positioned no farther from the axis than the predetermined distance so that the first portion is positioned, in the projection onto the plane, between the rails.

When the support element is a support roller or track, this roller/track may be rotatably provided in relation to a remainder of the second portion.

As mentioned, the drive may be embodied in a number of manners. The drive may be completely or partly mechanical and may require no external power source. Alternatively, the drive may require power to drive the support element in one direction between the operative and inoperative positions or in both directions.

The movement from the operative to the inoperative position may be selected according to e.g. the design of the frame. The support element may be translated horizontally toward the axis to move to the inoperative position. Alternatively or additionally, the support element may be rotated around an axis, such as an axis which is closer to the frame than the predetermined distance. The rotation may be around a rotational axis, such as a horizontal axis or a vertical axis. It may be desired that the support element, and sometimes all of the system, does not interfere with a passing wheel or with any portion of a passing train/wagon/car. When the support element is in the inoperative position, it is desired that no part of the pertaining support structure is positioned farther from the axis than the predetermined distance.

As will be described below, situations exist where the support element is attached to an element, such as a pushing element, which actually engages the passing wheel, where the engagement acts to position the support element in the inoperative position. In other situations, the movement of the support element takes place using other components where it may then be desired that no part of the system touches any part of the train/car/wagon.

In one embodiment, the drive element comprises a pushing element fixed in relation to the second portion, wherein, when projected onto the plane:

- at least part of the drive element extends farther than the predetermined distance from the longitudinal axis, when the pertaining support element is in the operative position, and
- no part of the drive element extends farther than the predetermined distance from the longitudinal axis, when the support element is in the inoperative position.

This pushing element may be configured to engage an approaching wheel of a train/car/wagon and use a relative velocity between the frame (or first portion of the pertaining support structure) and the wheel to displace in relation to the first portion and thereby cause a driving of the pertaining support element from the operative position to the inoperative position. Then, the passing wheel may cause both the support element and the pushing element to move out of the path of the wheel. When the wheel has passed, the pushing element may disengage the wheel and allow itself and the support element to return to the operative position.

In one situation, the pushing element is positioned higher than the support element. Preferably, the pushing element is positioned to engage the wheel at a height (along a vertical axis) closer to that of the rotational axis of the wheel, as that position of the wheel will be further along the direction of movement thereof than portions farther from the axis of rotation. Then, the pusher element may engage the wheel before the wheel reaches the support element.

Also, the pushing element may extend farther, in the projection and at the predetermined distance, along the longitudinal axis than any portion of the support element. In this manner, when the pushing element engages the wheel, the wheel will not engage the support element.

In one embodiment, the system further comprises a sensor for sensing an obstruction, such as a wheel, in the predetermined distance from the longitudinal axis and in the vicinity of a predetermined support element, the pertaining drive element being configured to, based on an output of the sensor, drive the predetermined support element from the operative position to the inoperative position.

In this embodiment, it may be desired that no portion of the system touches or engages any portion of the train/car/wagon.

Naturally, the sensor may sense obstructions, such as wheels, at a longer distance from the axis. Also, the sensor may be positioned to detect the obstruction before the obstruction reaches the pertaining support element to give the drive element time to, if not automatic, react and bring that support element to the inoperative position. If the wheel is always expected to travel in one direction on the rail, the sensor may be positioned to detect the wheel a position before the wheel arrives at the position at which the pertaining support element engages the rail.

Clearly, the same sensor may be used for controlling the operation of multiple drive elements. On the one hand, the wheels of trains, cars and wagons aways are provided in pairs so that the position of one wheel on one rail will dictate the position of a wheel on the other rail. On the other hand, the velocity of the wheel vis-à-vis the system may be determined so that the timing of the operation of the individual driving elements may be determined.

In one embodiment, the system further comprises a controller, the controller being configured to, based on a received signal, control the drive elements of all connection elements to drive all support elements to the inoperative position. Driving all support elements to the inoperative position allows the system to no longer support itself on the rails. The system may then enter this mode and sit, in the projection onto the plane, between the rails to not be in the way of train wheels moving along the rails.

This mode may be entered when the system has completed a task or when a malfunction is detected. Also, if a fast-moving train is approaching, the system may enter this mode if it is not able to operate the driving elements sufficiently fast enough for the wheels to be able to pass while at least some of the support elements are in the operative position. Clearly, other reasons may exist for entering this mode and thus avoiding interaction with the train wheels.

A second aspect of the invention relates to a method of operating the system according to the first aspect, the method comprising:

providing the system on the first and second rails of a railway track with the support elements in the operative position and engaging the first and second rails, the system passing a pair of wheels of a railway car standing on or moving along the first and second rails, by, for each support element:

when the support element approaches a wheel, the pertaining drive element drives the pertaining support element to the inoperative position and/or when the support element has passed the wheel, the pertaining drive element drives the pertaining support element to the operative position.

Naturally, all embodiments, situations and explanations made in relation to the first aspect are equally relevant to the second aspect. Thus, the system may comprise all of the above elements and may be operated as described above.

The wheels(s) of the train/car/wagon may travel along the rails, where the system, such as the frame, may remain stationary in relation to the rails or it may itself move along the rails.

A train/car/wagon often has multiple wheels, which are generally positioned in pairs of wheels positioned at the same position along the rails (an axle, a line or axis between the two wheels is perpendicular to the direction of the rails). Thus, the support elements on either side of the frame may be operated similarly and simultaneously.

The operative and inoperative positions are as described above. A support element may initially be in the inoperative state so that it needs not initially move away from an approaching wheel but will want to engage the rail after the wheel has passed. Also, a support element may not need to re-engage the rail after passing of the wheel. Situations exist where it may be desired to have only a minimum number of support elements engage the rails while maintaining a sufficient or desired position and support of the frame.

Often, however, the method will comprise both the driving of the support element to the inoperative position and to the operative state.

In general, the wheel may approach a support element when a relative velocity is seen between the two. Either element—or both—may move in relation to the rails. When the wheel approaches a support element (or vice versa), the pertaining drive element drives the pertaining support element to the inoperative position to allow the wheel to pass the position at which the support element engaged the upper surface of the rail. The inoperative position is preferably selected so that the support element, and in some situations any part of the support structure or system, does not interfere with, such as touch, the passing wheel.

In some situations, it is preferred that no part of the system touches any part of the wheel or the train/car/wagon when the wheel and system pass each other. In other situations, the system may comprise an element, such as a pusher element, engaging the passing wheel in order to drive the support element to the inoperative position.

Then, when the support element has passed the wheel, or vice versa, the pertaining drive element drives the pertaining support element to the operative position to again support the support element on the rail, often at the same position (in relation to the frame).

In one embodiment, the system moves along the rails. The train/wagon/car may be stationary in relation to the rails or they may also move along the rails. Alternatively, the system may be stationary in relation to the rails where the train/wagon/car move along the rails.

In one embodiment, the support elements are support rollers or tracks, the system further comprising a drive connected to at least two of the support rollers, the method comprising the step of the drive rotating the at least two support rollers/tracks. In this manner, the system may be able to move along the rails. It is preferred that a plurality of support rollers/tracks are driven, as this would allow some thereof to be in the inoperative position while others are in the operative position.

In one embodiment, the drive element of at least one connection element drives the support element to the inoperative position by moving a second portion, comprising the support element, in relation to a first portion fixed in relation to the frame. As mentioned above, the first portion may form part of the frame. The second portion may allow the support element to rotate in relation to the first portion or a part of the second portion.

The driving of the support element may be as described above.

In a preferred embodiment, a pushing element of the drive element of at the least one connection element engages one of the wheels, is pushed by a relative velocity between the wheel and the pushing element, and drives the pertaining support element from the operative position to the inoperative position. Thus, no extra power source is required, as the torque or force required may be derived from the moving wheel.

In one embodiment, a sensor outputs a signal when a predetermined support element approaches the wheel, the pertaining drive element receiving the signal and driving the predetermined support element from the operative position to the inoperative position.

The sensor may be any type of sensor, such as a camera, optical sensor, galvanic sensor, hall sensor or the like. The sensor may be configured to sense a position of a wheel, a velocity of the wheel, a direction of movement of the wheel or the like. The controlling may then be performed using a controller (on-board or remote) which may be used for that particular connection element, a plurality thereof or all connection elements.

In a particular embodiment, a controller receives a signal and controls the drive elements of all connection elements to drive all support elements to the inoperative position. This mode may be activated if a malfunction of the system is detected or e.g. a fast-moving train is expected.

BRIEF DESCRIPTION OF THE DRAWINGS

In the following, preferred embodiments of the invention will be described with reference to the drawing, wherein.

DETAILED DESCRIPTION OF VARIOUS EMBODIMENTS

Figure 1:
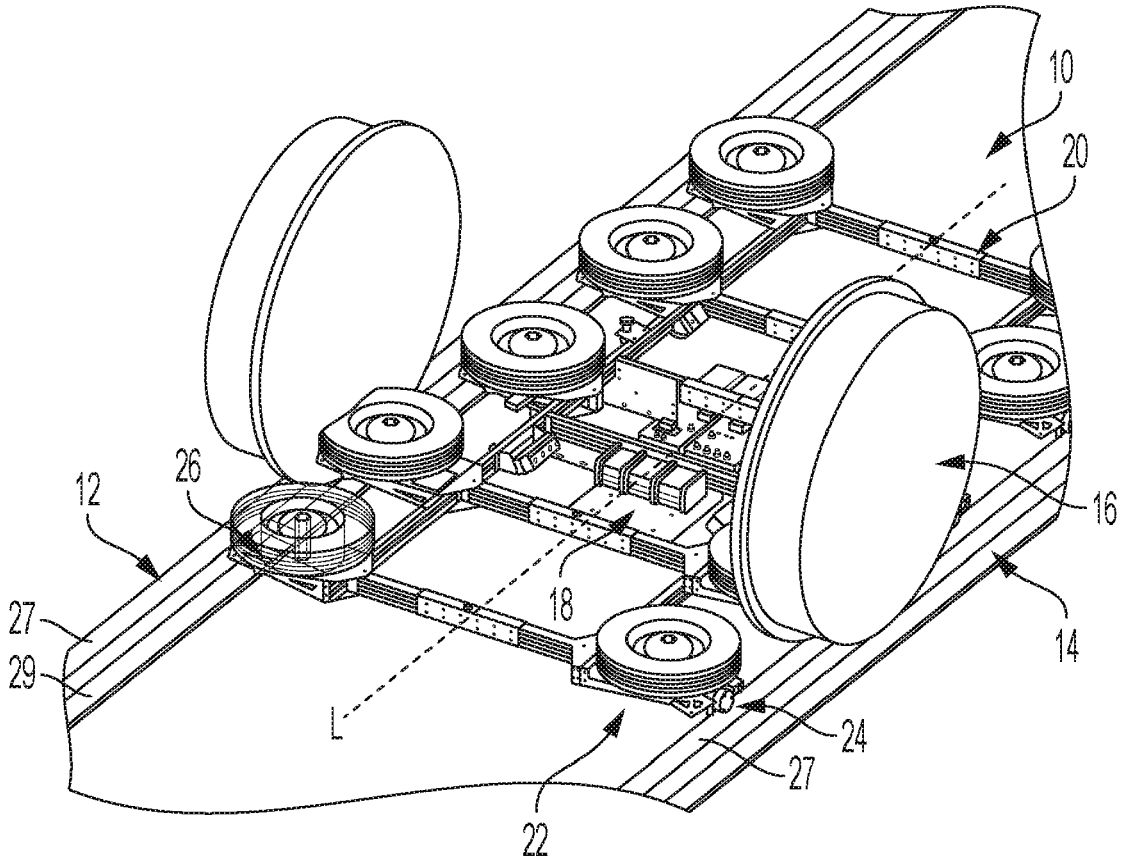
FIG. 1 illustrates a system for travelling along a railway track.

In FIG. 1 illustrates a system 10 configured to travel along first and second rails 12, 14, of a railway track, on which also trains and cars may travel, each on multiple sets of wheels, 16, which are supported on the rails 12, 14.

The system 10 may be used for a number of purposes, from analysis or inspection to e.g. interconnection of train cars and to separate transport of goods or other articles on the rails and even under the train/cars.

The system 10 comprises a frame 20 and, in this embodiment, 10 support structures 22 distributed to have 5 support structures on one side of a longitudinal axis L, and 5 support structures on the other side thereof.

Figure 2:
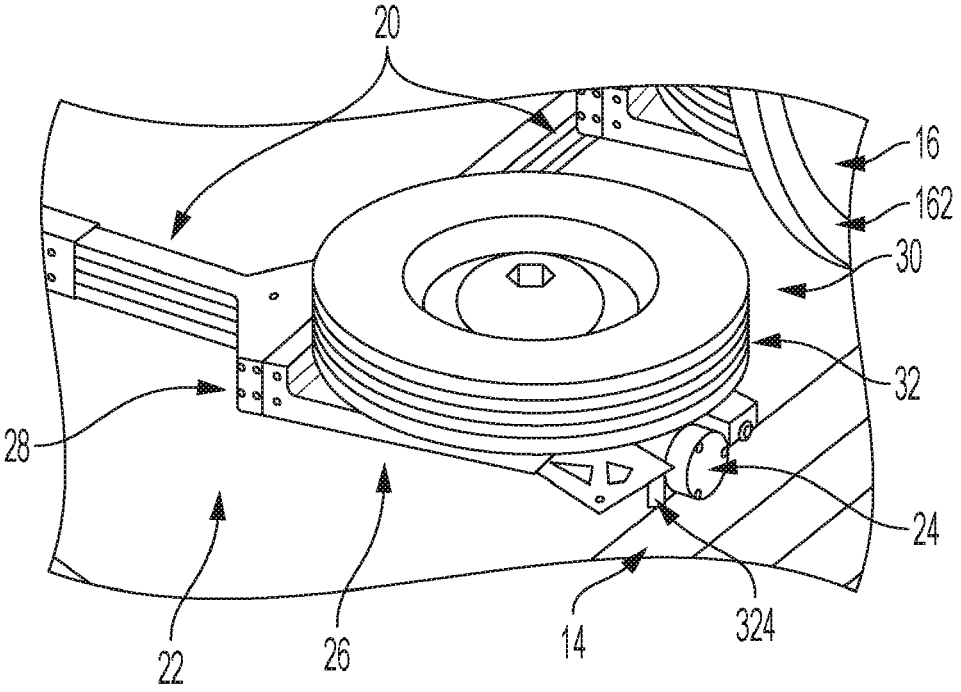
FIG. 2 illustrates a support structure.

As is also seen in FIG. 2, each support structure 22 has a support roller 24 configured to engage the top, also called running surface, of the pertaining rail 12/14, so as to support the system when driving along the track.

As is known, railway wheels are supported on the top of the rails, so that the support rollers 24 cannot easily move along the rails below a railway card. Also, the railway wheels have an inner protrusion, 162, extending downwardly, relative to the running surface, from the wheel and on the inner side of the rail. This is for ensuring that the train/car/wagon/truck stays on the track, but this protrusion also requires the support roller 24 to be removed from engagement with the rail when passing a wheel.

The support structure 22 comprises two portions which are movable in relation to each other. The portion 28 is attached to the frame 20, and the other portion, 26, is rotatably connected to the support roller 24.

In this embodiment, the portion 26 is translatable, perpendicular to the longitudinal axis, L, in relation to the portion 28 and the frame 20, so that the support roller 24 is moved inwardly of the rail 14 to allow the wheel 16 to pass without damaging the support roller 24. The support roller is moved sufficiently far inwardly to not engage with the wheel 16. This position is called the "inoperative" position of this roller, where the position illustrated, where the roller rests on the rail 14, is called the "operative position".

A drive 18 is provided for driving one, some of or all of the support rollers 24 to drive the system along the rails 12/14.

When a sufficient number of support structures 22 are provided on either side of the axis, L, the system 10 is able to move between multiple pairs of wheels 16 while a sufficient number of support rollers 24 engage the rail so that the system 10 may both remain supported by the rails and be able to move along them while different ones of the support structures bring the individual support rollers from the operative position to the inoperative position and back to the operative position.

The operative and inoperative positions may be defined by the distance from the support roller to the axis L, such as when the elements are projected onto a horizontal plane or a plane defined by the rails 12/14. When in the operative position, the support rollers are, in the projection, at or on the rails, whereas in the inoperative state, they are closer to the axis L. The threshold distance thus may be any distance between the axis L, often between relevant portions of the frame, and the innermost portions of the rails or the railcar wheels on the rails (taking into account the projection).

In FIGS. 1 and 2, a larger wheel, a pushing wheel, 32 is illustrated, which lies above the support roller 24 and extends farther along the directions of the axis L. The pusher wheel 32 extends at least as far away from the axis L as the support roller 24. The pusher wheel 32, in this embodiment, has the operation of moving the support roller from the operative to the inoperative position when a wheel 16 approaches. The pushing wheel 32 engages the approaching wheel 16 and is forced toward the axis L by the approaching wheel 16 and the fact that the wheel 32 is mounted on the portion 26 which is translatable in relation to the part 28 and the frame 20. This translation brings the pertaining support roller 24 away from the rail 14 so that the wheel 16 may pass. When the wheel 16 has passed, the wheel 32 disengages the wheel 16 and thus allows the portion 26 to extend so that the roller 24 may again support on the upper side of the rail 14. A spring or other resilient means may be provided for biasing the portion 26 toward having the support roller in the operational position.

Naturally, the pusher wheel 32 may not be connected directly to the portion 26 but may be in a geared relationship so that a relatively small displacement of the roller wheel 32 toward the axis L may bring about a larger displacement in the same direction of the support roller 24.

Small rollers 324 are seen engaging the inner surface of the rail 14. These are alternatives to the projections of the wheels 16 and also have the purpose of ensuring that the rollers 24 do not pass to the inner or outer sides of the rails 12/14. Alternatively, projections may be provided as on the wheel 16.

The portions 26 may, in fact, be biased toward the rail 14 in order to take into account situations where the distance between the rails varies slightly.

Multiple other manners exist of moving the supporting roller between the operative and inoperative position. Some of these manners are described in relation to FIGS. 3-4.

Figure 3:
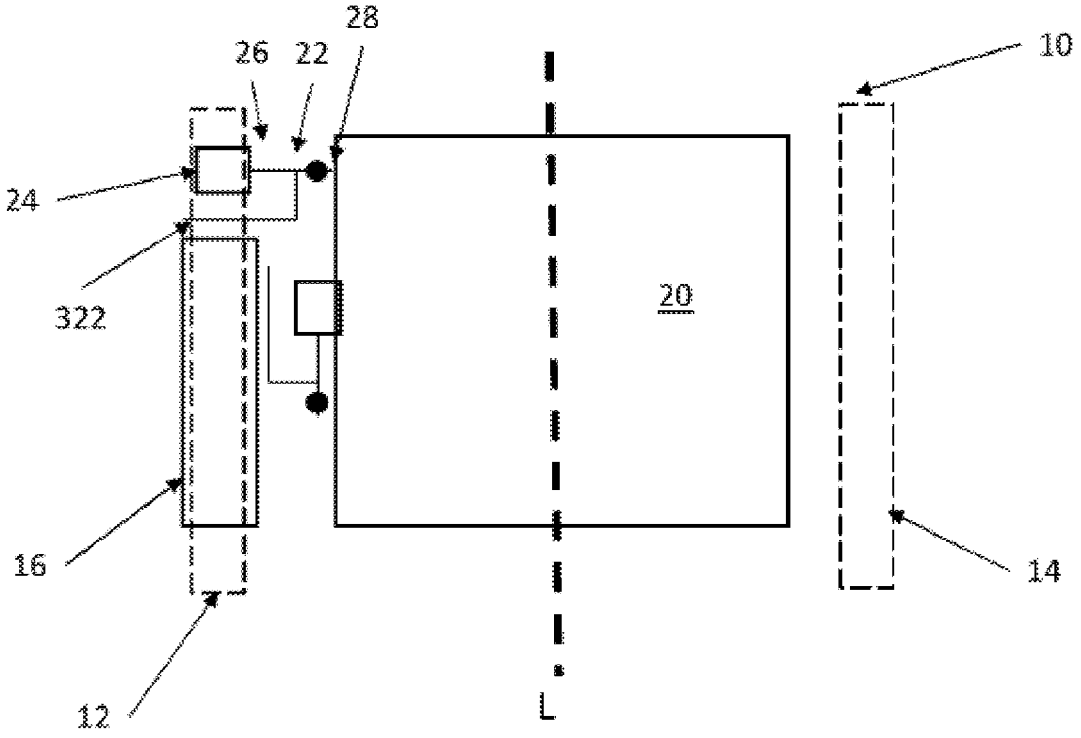
FIG. 3 illustrates a second manner of bringing the support roller to the inoperative position.

In FIG. 3, another manner of bringing the support roller 24 from the operative to the inoperative position is illustrated in the system 10 seen from above. Again, the frame 20 is attached to the support structure 22 having a first portion 28 fixed to the frame and another portion 26 movably, this time rotatably, attached to the portion 28 and to which the support roller 24 is rotatably attached.

In this embodiment, the portion 26 is rotatable around a vertical axis as illustrated. The portion 26 has a pusher element 322 positioned on the side of the support roller 24 from which the rail car wheel 16 approaches. In FIG. 3, the rail car wheel moves upwardly along the rail 12.

It is seen that the pusher element 322 will engage the wheel 16 before it reaches the support roller 24 and will push the portion 26 along the direction of travelling, causing the portion 26 to rotate, as the support structure 22 supports this rotation.

The pusher element 322 will remain between the support roller 24 and the wheel 16 until the wheel 16 is out of engagement, whereafter the portion 26 will rotate back to the operative position.

Figure 4:
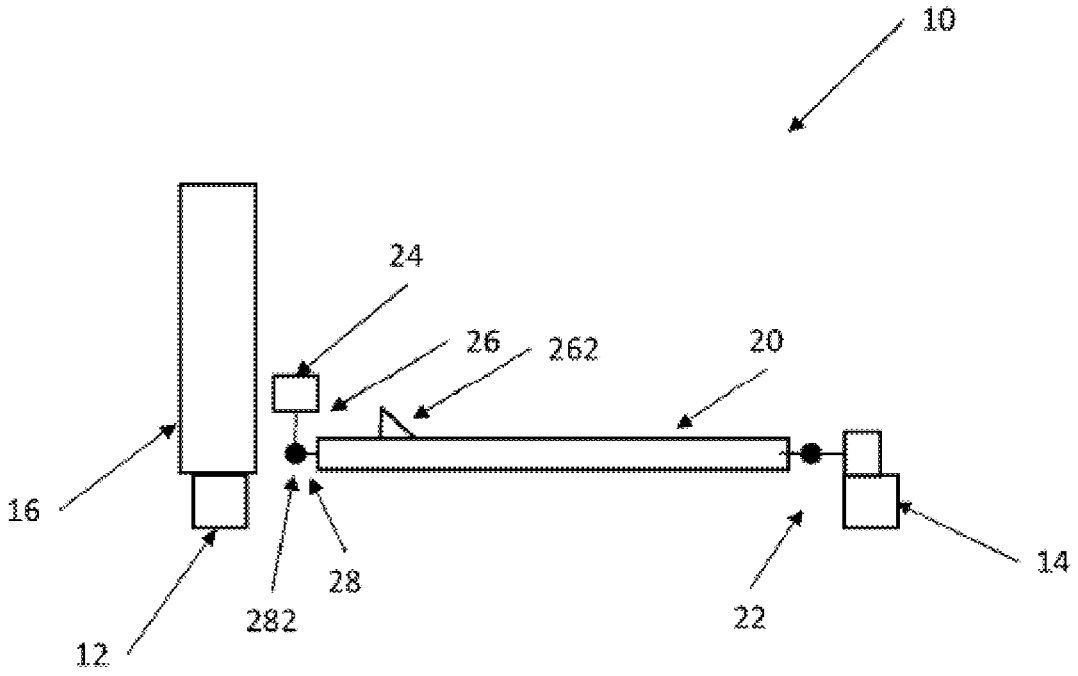
FIG. 4 illustrates yet another manner of bringing the support roller to the inoperative position.

In FIG. 4, a rotation around a horizontal axis brings the support roller 24 from the operative position (illustrated to the right) to the inoperative position illustrated to the left.

Above, the manner of bringing the support roller into the inoperative position has been described using direct engagement of a portion of the system and the approaching train car wheel. Naturally, other manners are useful also, such as a sensor 262 configured to sense or detect the arriving wheel 16, such as a position thereof. This sensor 262 may output a signal to a controller (may be in the drive system 18) which may operate a drive element 282 configured to bring the pertaining support roller 24 into the inoperative position and/or between the operative and inoperative positions. This sensor may be image based, sound based or may be of any other type.

One sensor is not required for each support structure 22, if the velocity of the wheel 16 is known, relative to the system 10, such as if the train car comprising the wheel 16 is stationary vis-à-vis the rails 12/14 where the system 10 may know its own speed vis-à-vis the rails 12/14, such as by controlling its drive 18. In such situations, the position of the wheel 16 vis-à-vis each individual support structure on the same rail may be known over time, so that the wheel may be detected when approaching the system proper and, then, individual support structures may be operated at determined points in time to allow the wheel 16 to pass without damage to the system 10.

In one embodiment, the support roller 24 may have a square cross section in a plane comprising the axis of rotation. In another embodiment the support roller may have a conical cross section in that plane. This is relevant e.g. when the translation of FIG. 1 is seen, as the frame and/or portions 26/28 may not be perfectly stiff, so that the support roller when approaching the rail when being brought back to the operative state, may be slightly offset downwardly, where the conical shape may assist in ensuring that the roller again engages the upper side of the rail.

Another reason for having conical rollers is that they, when paired with a solid axle or a mechanism that makes left and right rollers turn the same amount, keep the frame centered between the rails. With cylindrical rollers, it would be preferable to actively steer to stay on the rails. With coupled conical rollers, when the system starts to deviate to one side, then the roller on that side engages the rail with a larger diameter than the roller on the other side. Because the two rollers are coupled, the larger diameter makes the roller on the side toward which the system has deviated move farther than the roller on the other side, steering the system back to center.

In one embodiment, a controller (may be part of the drive 18) may be provided and may be capable of controlling all support structures to bring the corresponding support rollers to the inoperative state. When all support rollers go to the inoperative state, the system 10 will no longer be supported by the rails but may fall to the ground between the rails. This may be a safety feature allowing the system 10 to remain intact in situations where trains and cars travel on the rails. If, for example, a train is approaching at a speed so fast that the support structures are not able to react sufficiently, this mode may be assumed so that the system is not destroyed by the train.

In the above embodiments, the system has been described using support rollers. Naturally, alternative types of elements may be used, such as tracks. Also, above, a drive is described rotating at least some of the support rollers to move the system along the rails. Clearly, other types of drives may be used, such as drives engaging the wheels, rail cars/wagons, the ground or the rails in other manners, so that the support rollers/tracks need not be driven. Actually, the above support rollers may be replaced by other support elements than rollers, such as non-rotating elements, which may slide along the rails. Sliding may not even be required, as the system may be configured to sit in a stationary manner on the tracks where the train/car/wagon/wheels move along the track.

The invention claimed is:

1. A system comprising a frame having a longitudinal axis and, on each of two opposite sides of the longitudinal axis, a plurality of support structures each comprising:

a support element configured to engage an upper surface of a railway rail, a connection element connecting the support element to the frame, the connection element allowing the support element to move, relative to the frame, from an operative position to an inoperative position, the connection element comprising a drive element for driving the support element from the operative position to the inoperative position and/or from the inoperative position to the operative position, where:

at least part of each support element of each support structure on one of the sides of the longitudinal axis extends, when in the operative position and when the system is projected onto a horizontal plane, farther than a predetermined distance from the longitudinal axis, at least part of each support element of each support structure on the other of the sides of the longitudinal axis, the other side being opposite to the first side, extends, when in the operative position and when the system is projected onto the horizontal plane, farther than the predetermined distance from the longitudinal axis, no part of the support elements extends, when in the inoperative position and when the system is projected onto the horizontal plane, farther than the predetermined distance from the longitudinal axis, wherein at least one connection element comprises:

a first portion fixed in relation to the frame, a second portion comprising the support element, the second portion being movable, by the pertaining drive element, in relation to the first portion to bring the support element from the operative position to the inoperative position, wherein the drive element comprises a pushing element fixed in relation to the second portion, wherein, when projected onto the horizontal plane:

at least part of the drive element extends farther than the predetermined distance from the longitudinal axis, when the pertaining support element is in the operative position, and no part of the drive element extends farther than the predetermined distance from the longitudinal axis, when the support element is in the inoperative position.

2. The system according to claim 1, further comprising a drive for moving the system along the rails.

3. The system according to claim 2, wherein the support elements are support rollers, the system further comprising a drive connected to at least two of the support rollers so as to rotate these.

4. The system according to claim 1, wherein the pushing element is positioned higher than the support element and extends farther, in the projection and at the predetermined distance, along the longitudinal axis than any portion of the support element.

5. The system according to claim 1, further comprising a sensor for sensing an obstruction in the predetermined distance from the longitudinal axis and in the vicinity of a predetermined support element, the pertaining drive element being configured to, based on an output of the sensor, drive the predetermined support element from the operative position to the inoperative position.

6. The system according to claim 1, the system further comprising a controller, the controller being configured to, based on a received signal, control the drive elements of all connection elements to drive all support elements to the inoperative position.

7. A method of operating the system according to claim 1, the method comprising:

providing the system on the first and second rails of a railway track with the support elements in the operative position and engaging the first and second rails, the system passing a pair of wheels of a railway car standing on or moving along the first and second rails, by, for each support element:

when the support element approaches a wheel, the pertaining drive element drives the pertaining support element to the inoperative position and/or when the support element has passed the wheel, the pertaining drive element drives the pertaining support element to the operative position.

8. The method according to claim 7, further comprising the step of moving the system along the rails.

9. The method according to claim 8, wherein the support elements are support rollers, the system further comprising a drive connected to at least two of the support rollers, the method comprising the step of the drive rotating the at least two support rollers.

10. The method according to claim 7, wherein the drive element of at least one connection element drives the support element to the inoperative position by moving a second portion, comprising the support element, in relation to a first portion fixed in relation to the frame.

11. The method according to claim 7, wherein a pushing element of the drive element of at the least one connection element engages one of the wheels, is pushed by a relative velocity between the wheel and the pushing element and drives the pertaining support element from the operative position to the inoperative position.

12. The method according to claim 7, wherein a sensor outputs a signal when a predetermined support element approaches the wheel, the pertaining drive element receiving the signal and driving the predetermined support element from the operative position to the inoperative position.

13. The method according to claim 7, wherein a controller receives a signal and controls the drive elements of all connection elements to drive all support elements to the inoperative position.

* * * * *